US008266842B2

(12) United States Patent
Merrick et al.

(10) Patent No.: US 8,266,842 B2
(45) Date of Patent: Sep. 18, 2012

(54) STADIUM SEATING CONSTRUCTION

(75) Inventors: Bruce C. Merrick, Louisville, KY (US); Brian DeHart, Louisville, KY (US)

(73) Assignee: Dant Clayton Corporation, Louisville, KY (US)

( * ) Notice: Subject to any disclaimer, the term of this patent is extended or adjusted under 35 U.S.C. 154(b) by 34 days.

(21) Appl. No.: 12/780,310

(22) Filed: May 14, 2010

(65) Prior Publication Data

US 2011/0277390 A1 Nov. 17, 2011

(51) Int. Cl.
*E04H 3/12* (2006.01)
*E04F 11/00* (2006.01)

(52) U.S. Cl. ..... 52/8; 52/188; 52/189

(58) Field of Classification Search ..... 52/8, 182, 52/184, 188, 189, 190, 191
See application file for complete search history.

(56) References Cited

U.S. PATENT DOCUMENTS 1,353,377 A * 9/1920 Bois ..... 52/188
1,412,788 A * 4/1922 Lehman ..... 52/191
1,452,467 A * 4/1923 Byron ..... 52/8
1,457,515 A * 6/1923 Frisch ..... 52/179
1,565,580 A * 12/1925 Manton ..... 52/188
1,593,360 A * 7/1926 Hiram et al. ..... 52/191
1,679,570 A * 8/1928 Hall ..... 52/191
1,771,405 A * 7/1930 Felsenthal ..... 52/191
1,789,969 A * 1/1931 Davis ..... 52/191
1,792,792 A * 2/1931 Woodbridge ..... 52/179
1,835,759 A * 12/1931 Cook ..... 52/188
1,965,486 A * 7/1934 Cannon ..... 52/8
2,205,859 A * 6/1940 O'Donnell ..... 52/188
2,466,982 A * 4/1949 Easterwood ..... 52/8
2,555,002 A * 5/1951 Phillips et al. ..... 52/188
2,817,389 A * 12/1957 Richards ..... 52/8
2,949,703 A * 8/1960 Katzmarek ..... 52/188
3,099,336 A * 7/1963 Hawkins ..... 52/182
3,257,761 A * 6/1966 Klein ..... 52/126.5
4,244,154 A * 1/1981 Weaver ..... 52/185
4,790,594 A 12/1988 Temos
4,893,442 A 1/1990 Graham et al.
5,014,475 A 5/1991 Anderson, Jr. et al.
5,159,788 A * 11/1992 Merrick ..... 52/8
5,511,347 A 4/1996 Schwarz
5,660,009 A * 8/1997 Cousin ..... 52/183
5,960,589 A 10/1999 Youngquist et al.
6,474,024 B1 11/2002 Macintyre
6,922,947 B2 * 8/2005 Jines et al. ..... 52/7
7,047,699 B2 5/2006 Kennedy
(Continued)

FOREIGN PATENT DOCUMENTS

JP 06307044 A * 11/1994

*Primary Examiner* — Robert Canfield
*Assistant Examiner* — Brent W Herring
(74) *Attorney, Agent, or Firm* — Woodard, Emhardt, Moriarty, McNett & Henry LLP

(57) ABSTRACT

A stadium and arena seating system is provided which utilizes concrete tread surfaces and metallic or other non-concrete vertical risers therebetween. The concrete treads have front and rear embeds embedded within the front and rear ends of the treads respectively. The embeds comprise a metallic or other non-concrete material similar to the vertical risers. The vertical risers are arranged in a shingled or other self-sealing fashion between the embeds of the treads to provide water and debris shedding. In certain embodiments, an overlapping vertical riser may be used which provides water shedding without the need for embeds within the concrete tread surfaces.

39 Claims, 19 Drawing Sheets

U.S. PATENT DOCUMENTS

| | | | | |
|---|---|---|---|---|
| 7,073,858 | B2 | 7/2006 | Fisher et al. | |
| 7,617,652 | B1 * | 11/2009 | Flatmoe | 52/653.2 |
| 7,905,060 | B2 * | 3/2011 | Brunner | 52/8 |
| 2004/0020142 | A1 | 2/2004 | Kress | |
| 2006/0150540 | A1 | 7/2006 | Kennedy | |
| 2009/0151275 | A1 * | 6/2009 | Naccarato et al. | 52/182 |
| 2009/0272042 | A1 * | 11/2009 | Brunner | 52/8 |

* cited by examiner

STADIUM SEATING CONSTRUCTION

FIELD OF THE INVENTION

Embodiments of the present invention deal with stadium and arena seating structures, and in particular to seating structures which utilize a combination of concrete and metallic components.

BACKGROUND OF THE INVENTION

The grandstand, stadium and arena seating industry has traditionally relied on two main types of construction to provide adequate walking surfaces, or treads, and associated riser surfaces therebetween. The first of these is a reinforced concrete system utilizing concrete for both the horizontal tread and vertical riser portions. Concrete provides excellent performance in relation to vibration, noise transfer, and deflection. However, concrete also has its drawbacks. For example, in a typical concrete system, two or three row precast pieces spanning twenty to fifty feet are poured at the factory and shipped to the jobsite for installation. The pieces include very thick reinforced concrete treads and risers. Caulk must then be used to seal the horizontal joints where the precast pieces meet and prevent water seepage. The forms needed to pour these pieces are fairly expensive and typically cannot be reused from one project to the next due to custom configurations in the seating bowl. Some systems utilize concrete treads which are poured on site, which causes other concerns regarding the unpredictability of jobsite temperature and humidity conditions in addition to the added cost of on-site concrete pouring equipment.

In addition, an all-concrete system requires that epoxy or expansion anchors be used to attach the seats or benches to the concrete treads and risers, a process that typically requires expensive field drilling and time for the epoxy to cure. The concrete system is also extremely heavy and difficult to install and requires a stronger steel or concrete understructure for support.

The other type of construction commonly used involves metallic treads and risers, often aluminum, supported by a steel understructure. The aluminum treads typically span only about six feet, and are typically supported by steel stringers positioned on six foot centers. The aluminum system provides more cost effective options for installation, final adjustment, and seat mounting, although typically cannot match the performance characteristics of the concrete system. Aluminum systems also offer more options in terms of vertical surface coloring and may be more easily modified on a project to project basis.

SUMMARY OF THE INVENTION

According to one aspect, a stadium seating construction system is disclosed. The system comprises a tiered support understructure, a plurality of tiered concrete treads, and a plurality of tiered risers. The treads are mounted to the stadium seating support understructure and have a concrete body portion, a non-concrete front embed embedded within a front end of the concrete body portion, and a non-concrete rear embed embedded within a rear end of the concrete body portion. The front and rear embeds and risers may be formed from a non-concrete material such as metal, plastic, or fiberglass.

According to another aspect, the rear embed may have an upwardly extending portion for shedding water from the upper adjacent riser.

According to another aspect, the front embed may have a first connection device. The first connection device may be adapted to interlock with a second connection device of a lower adjacent riser.

According to another aspect, the risers are arranged such that a lower portion of the riser overlaps with a forward side of the upwardly extending portion of the rear member of a lower adjacent tread.

According to another aspect, the concrete treads comprise at least one hole through which a fastener for fastening the tread to the support understructure may be inserted.

According to another aspect, the concrete treads comprise at least one non-concrete lower embed, said non-concrete lower embed having a fastener for fastening the tread to the stadium seating support understructure According to another aspect, the front embed comprises at least one horizontal channel for receiving an upper seat fastener. The rear embed likewise comprises at least one horizontal channel for receiving a lower seat fastener.

According to another aspect, the risers further comprise at least one attachment device for attaching a seat.

According to another aspect, a stadium seating construction system is disclosed comprising a tiered stadium seating support understructure, a plurality of tiered concrete treads mounted to the stadium seating support understructure, and a plurality of tiered risers. At least one of the risers has a central vertical portion and an optional lower horizontal portion extending forward from the central vertical portion and is mounted such that the lower horizontal portion sits on top of a lower adjacent tread to achieve a water shedding effect. The risers may optionally be attached to the front end of an upper adjacent concrete tread or the rear end of a lower adjacent concrete tread using a fastener.

DESCRIPTION OF THE ILLUSTRATED EMBODIMENTS

For the purposes of promoting an understanding of the principles of the invention, reference will now be made to the embodiments illustrated and specific language will be used to describe the same. It will nevertheless be understood that no limitation of the scope of the invention is thereby intended, such alterations, modifications, and further applications of the principles of the invention being contemplated as would normally occur to one skilled in the art to which the invention relates.

As used in the claims and specification, the term "stadium seating" refers to any tiered structure built to provide seating or standing accommodations for spectators at a sporting or other public or private event.

As used in the claims and specification, the term "seat" refers to chairs, benches or any structure upon which a person may sit and intended for use in a stadium seating structure.

Figure 1:
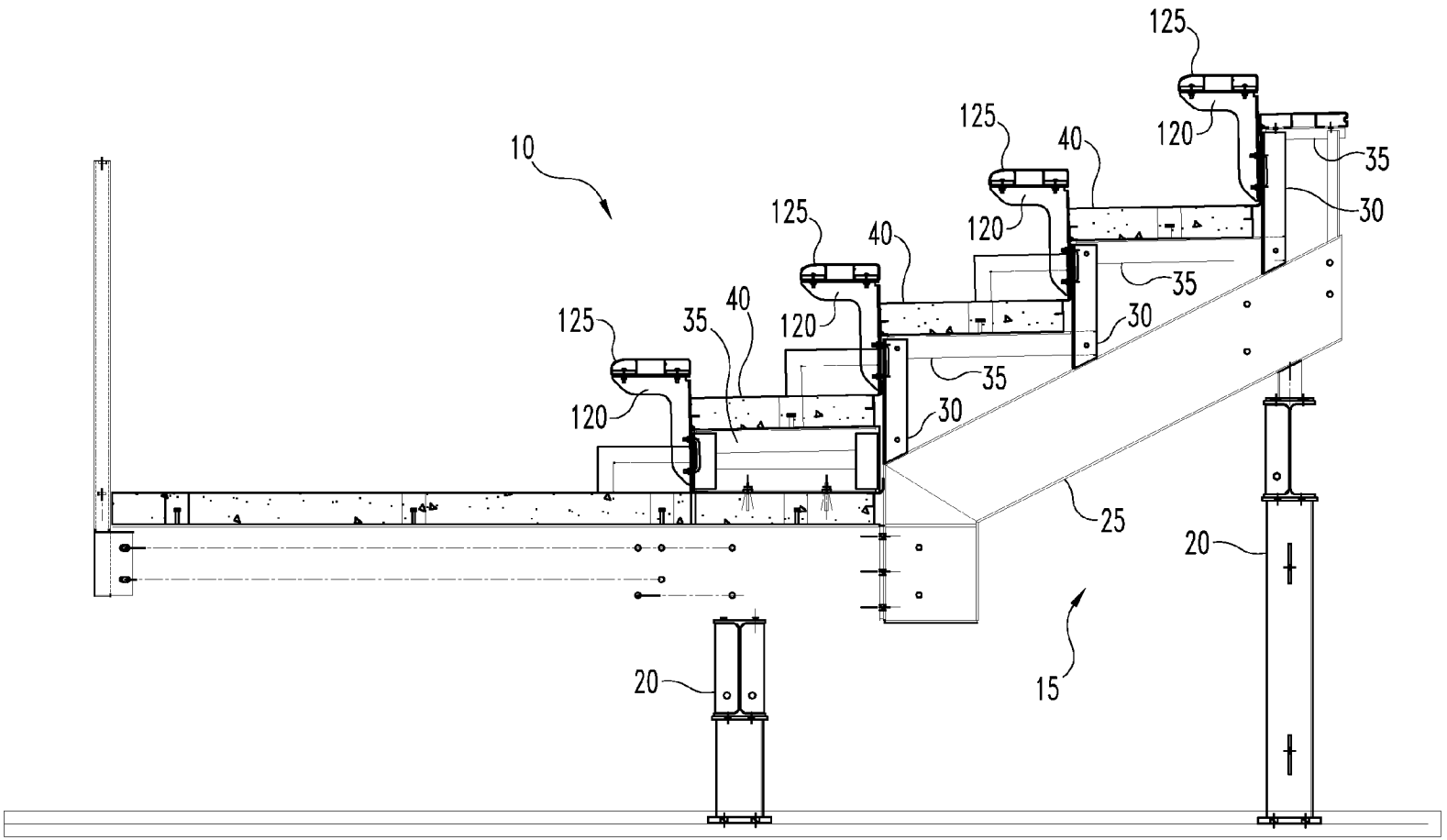
FIG. 1 is a side view of a stadium seating system according to one embodiment of the present disclosure.

FIG. 1 shows a side view of a stadium seating construction system 10 according to one embodiment of the present disclosure. A support understructure 15 includes main support beams 20 and stringers 25, which support tiered riser supports 30 and runner supports 35. The various understructure components may be attached using any fastening method known in the art including, but not limited to, welding, riveting and bolting. It shall be understood that the cross-sectional geometry of the understructure components may include I-beams, "L" beams, "T" beams, cylindrical columns or any other support geometry known in the art. It shall be further understood that support understructure 15 may comprise additional metallic or concrete structural components to achieve the support requirements of the given application.

In a preferred embodiment, treads 40 are placed on top of runner supports 35 such that multiple runner supports 35 are supporting each tread 40. The treads 40 are preferably comprised of individual concrete sections, each with a span of approximately six feet, although the span may be adjusted depending on the application requirements. In a preferred embodiment, the treads 40 will be pre-cast in a controlled factory environment before being delivered to the jobsite, although cast-in-place concrete may be used as well. Pre-cast treads are also easier to install and typically provide greater strength in relation to an equal size cast-in-place unit. The reduced span length also eliminates the need for prestressing.

Figure 2:
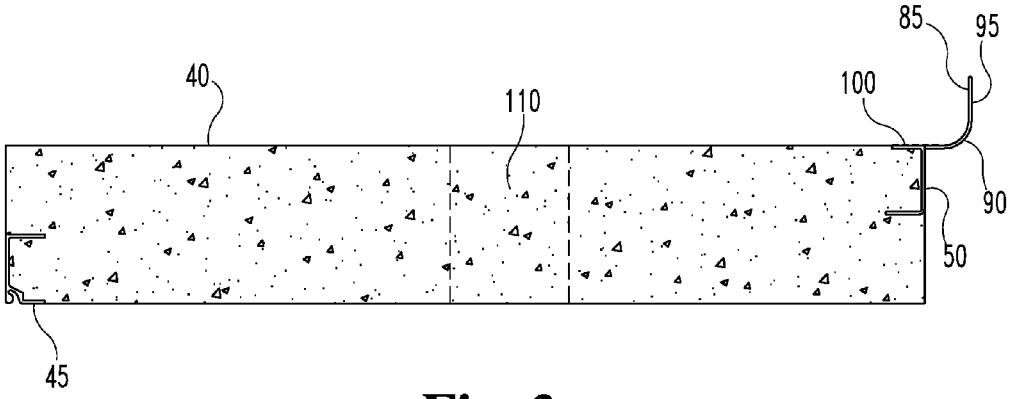
FIG. 2 is a side view of a concrete tread with front and rear embeds according to one embodiment of the present disclosure.
Figure 3:
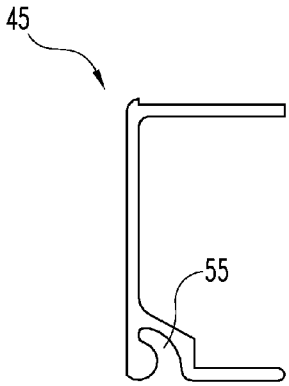
FIG. 3. is a cross-sectional view of the a front embed of the tread of FIG. 2.
Figure 4:
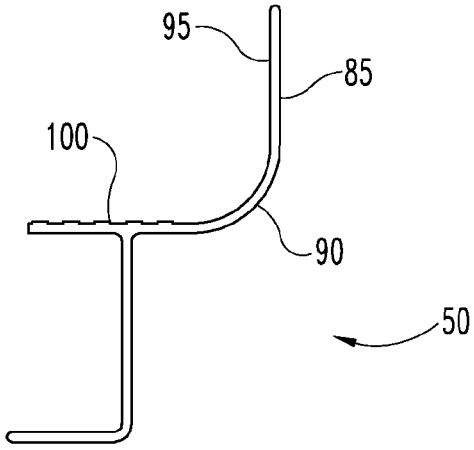
FIG. 4 is a cross-sectional view of a rear embed of the tread of FIG. 2.
Figure 6:
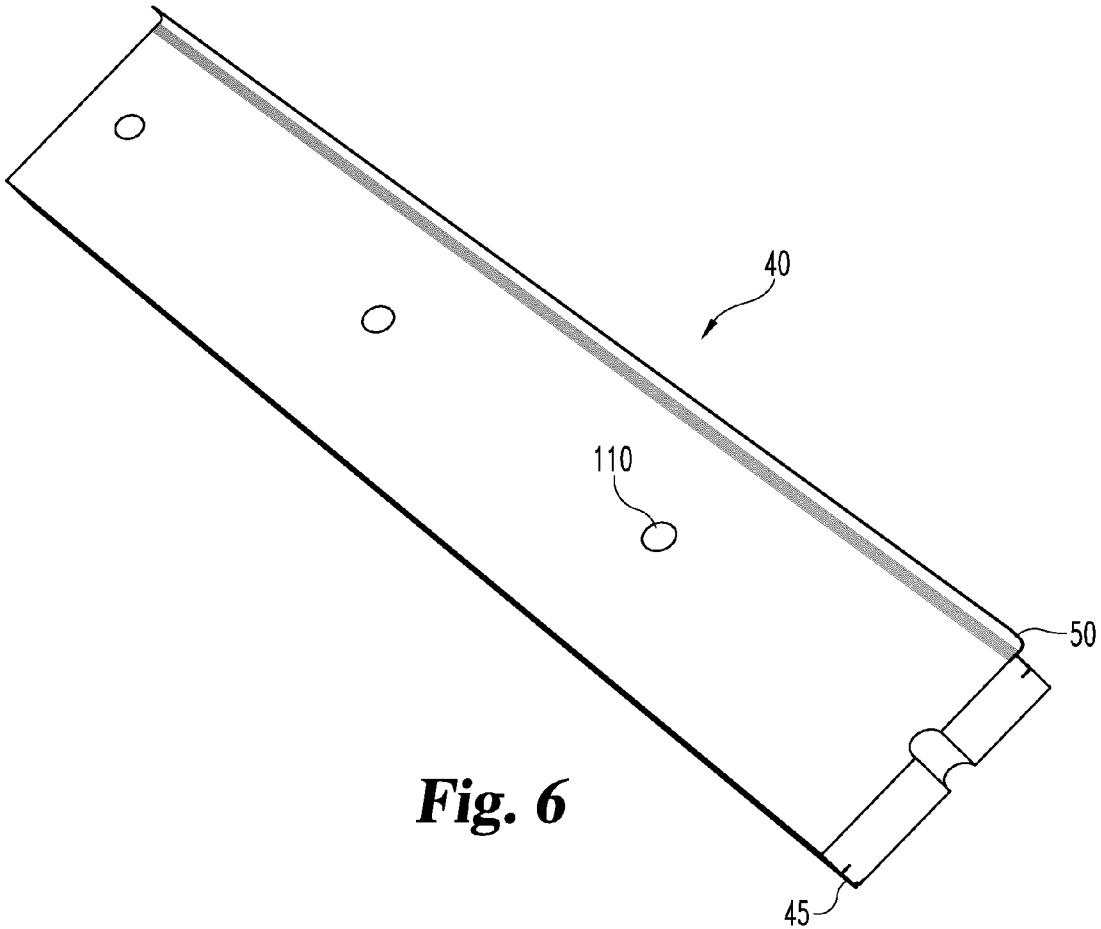
FIG. 6 is a perspective view of the concrete tread of FIG. 2.

The treads 40 may optionally include a front embed 45 and a rear embed 50 which are embedded into the front and rear portions, respectively, of treads 40 (FIGS. 2 & 6). FIGS. 3 and 4 show a detailed view of the cross-sectional profiles of embeds 45 and 50, respectively. Embeds 45 and 50 may comprise a metallic material, such as aluminum or steel, although other types of material may also be used including, but not limited to, plastic, fiberglass and composite materials. The embeds 45 and 50 may optionally be formed using an extrusion process and embedded into the tread 40 when the concrete comprising tread 40 is initially poured.

Figure 5:
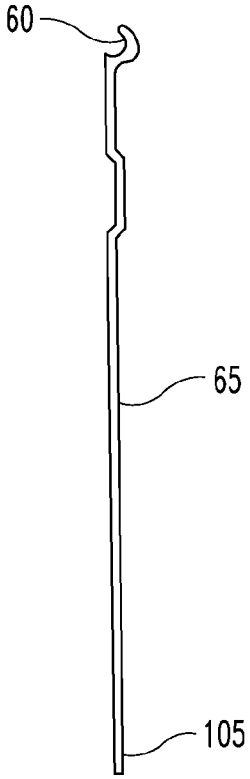
FIG. 5 is a cross-sectional view of riser according to one embodiment of the present disclosure.
Figure 7:
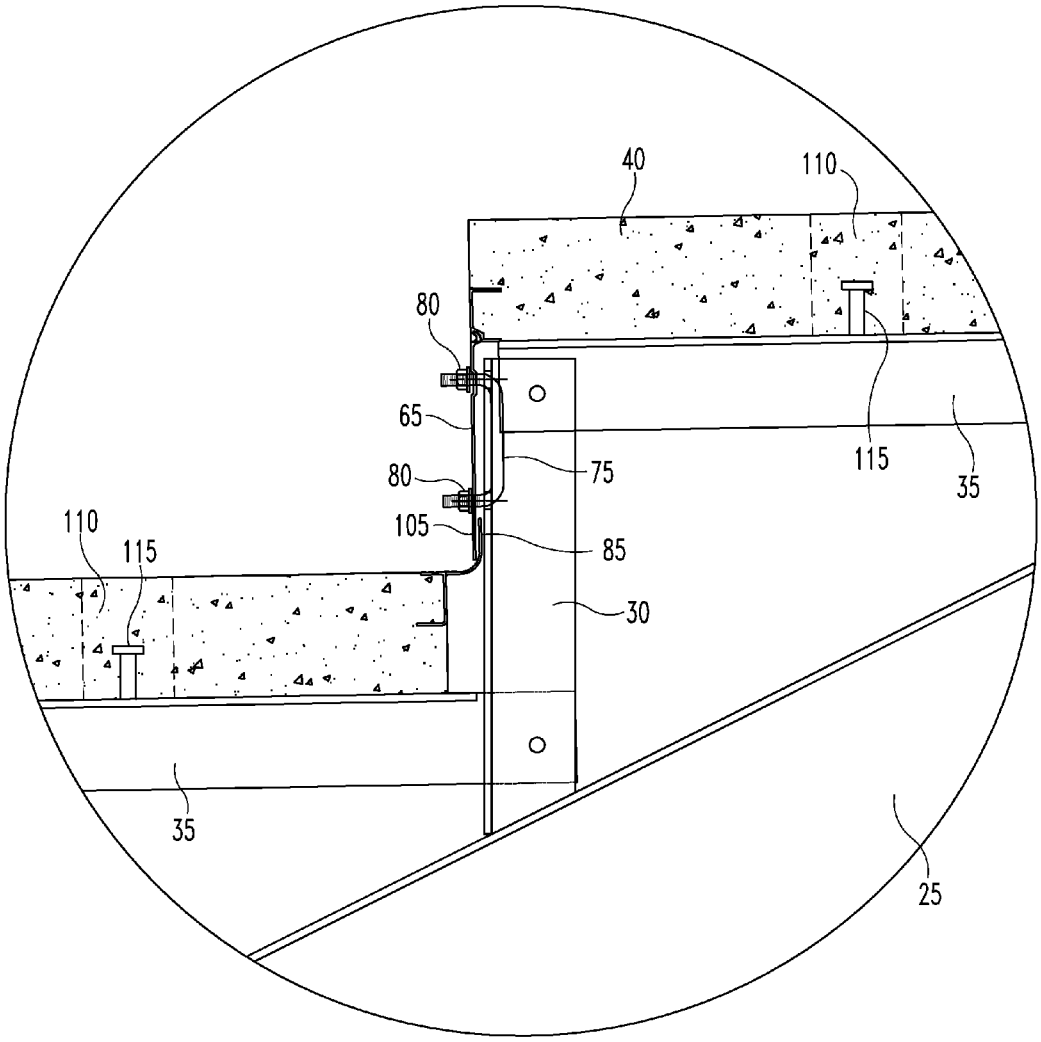
FIG. 7 is an enlarged side view of a portion of the stadium seating system of FIG. 1.

In order to provide a self-sealing continuous surface which will shed water and other debris and prevent seepage into the understructure, the front embed 45 may optionally comprise a connection device, shown in FIG. 3 as a female recess 55. The recess 55 engages a corresponding connection device, shown here as a male lip portion 60, of a riser 65 (FIG. 5). As shown in FIG. 7, once the male lip portion 60 is inserted into the recess 55, the riser 65 may optionally be attached to the riser supports 30 using bolts 75 and nuts 80. It shall be understood that other types of mechanical fasteners known in the art may also be used to attach the riser 65 to the riser support 30.

In a preferred embodiment, the rear embed 50 may optionally comprise an upwardly-extending portion 85 (FIG. 4). The rear embed 50 may also comprise a curved portion 90 which provides a smooth transition from the vertical portion 95 to the horizontal portion 100. When the riser 65 is attached to the riser support 30 as shown in FIG. 7, the lower portion 105 of the riser 65 will be adjacent to the forward side of the upwardly-extending portion 85 of the lower adjacent rear embed 50. This overlapping shingled arrangement allows the combination of the riser 65 and the rear embed 50 to shed water and other debris down the surfaces of the seating system 10 without the need for caulking or welding where the risers 65 and rear embeds 50 meet. The arrangement further allows some vertical adjustability in the mounting of the risers 65 relative to the treads 40 as the only requirement is that the riser 65 and rear embeds 50 overlap enough to effectively shed water. This vertical adjustability also allows uniform thickness treads to be poured in flat beds and used in multiple projects, eliminating the need for custom forms for each project.

It shall be understood that while the illustrated embodiment depicts an arrangement wherein the upper portion of the risers 65 interlock with the front embed 45 of an upper adjacent tread 40, other variations on this arrangement are contemplated to be within the scope of the present disclosure. For example, the front embed 45 may simply comprise a downwardly-extending lip which overlaps the front side of the upper portion of a lower adjacent riser 65 in a shingled manner. Likewise, the lower portion of the riser 65 may comprise a connection device which interlocks with a corresponding connection device within a rear embed 50 of a lower adjacent tread 40.

It shall be further understood that while the illustrated embodiment depicts two separate embeds 45 and 50 in the tread 40, the embeds 45 and 50 may actually be formed as a single member which runs from the front to the rear ends of tread 40 on the bottom or top surface of tread 40.

In certain embodiments, the treads 40 may include holes 110. Holes 110 are preferably formed when the concrete treads 40 are poured, or alternatively cut into the treads 40 at the factory. The holes 110 allow the treads 40 to be easily mounted to the runner supports 35 from the top side of the treads 40 using any appropriate fastener known in the art. In one embodiment, studs 115 may be welded to the runner supports 35, whereby the studs 115 serve as the lower portion of a fastening device (FIG. 7). For example, a precast tread 40 may be set in place, after which time the installer can simply attach a corresponding upper fastener to each stud from above, without the need to reach under or otherwise manipulate a lower fastener below the tread 40. It shall be understood that other types of fasteners known in the art may also be inserted through the holes 110 to secure the treads 40 to the runner supports 35.

As shown in FIG. 1, seat brackets 120 may be attached to the risers 65 to support seating surfaces 125. This allows the mounting of the seating surfaces 125 to be achieved without the need for labor-intensive concrete anchors. In other embodiments, the seat brackets 120 may be secured directly to the riser supports 30, with the bolts 75 and nuts 80 being used to secure both the seat brackets 120 and the risers 65.

Figure 8:
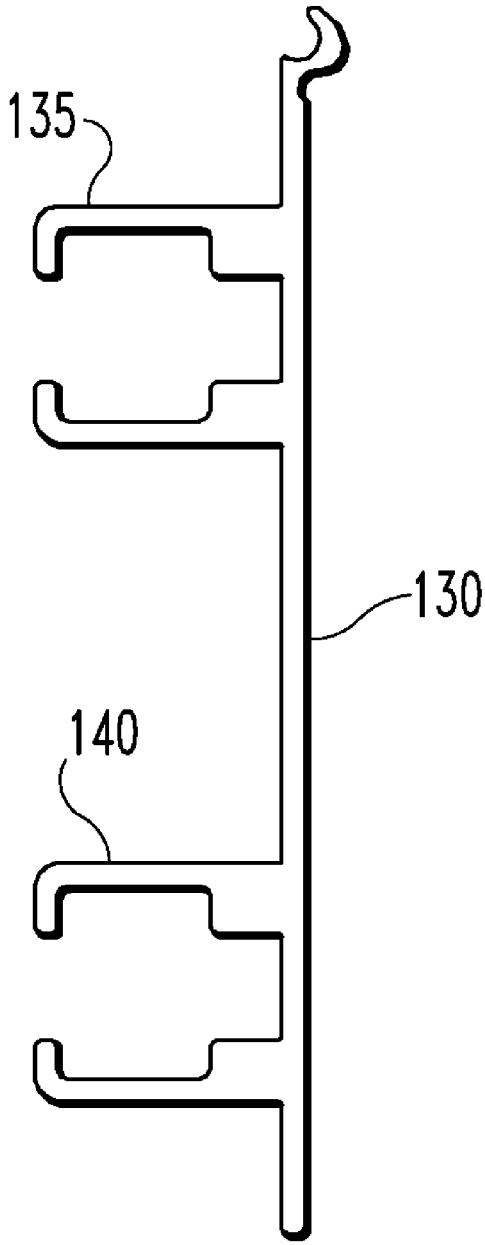
FIG. 8 is a cross-sectional view of a riser with channels formed therein according to a further embodiment of the present disclosure.
Figure 9:
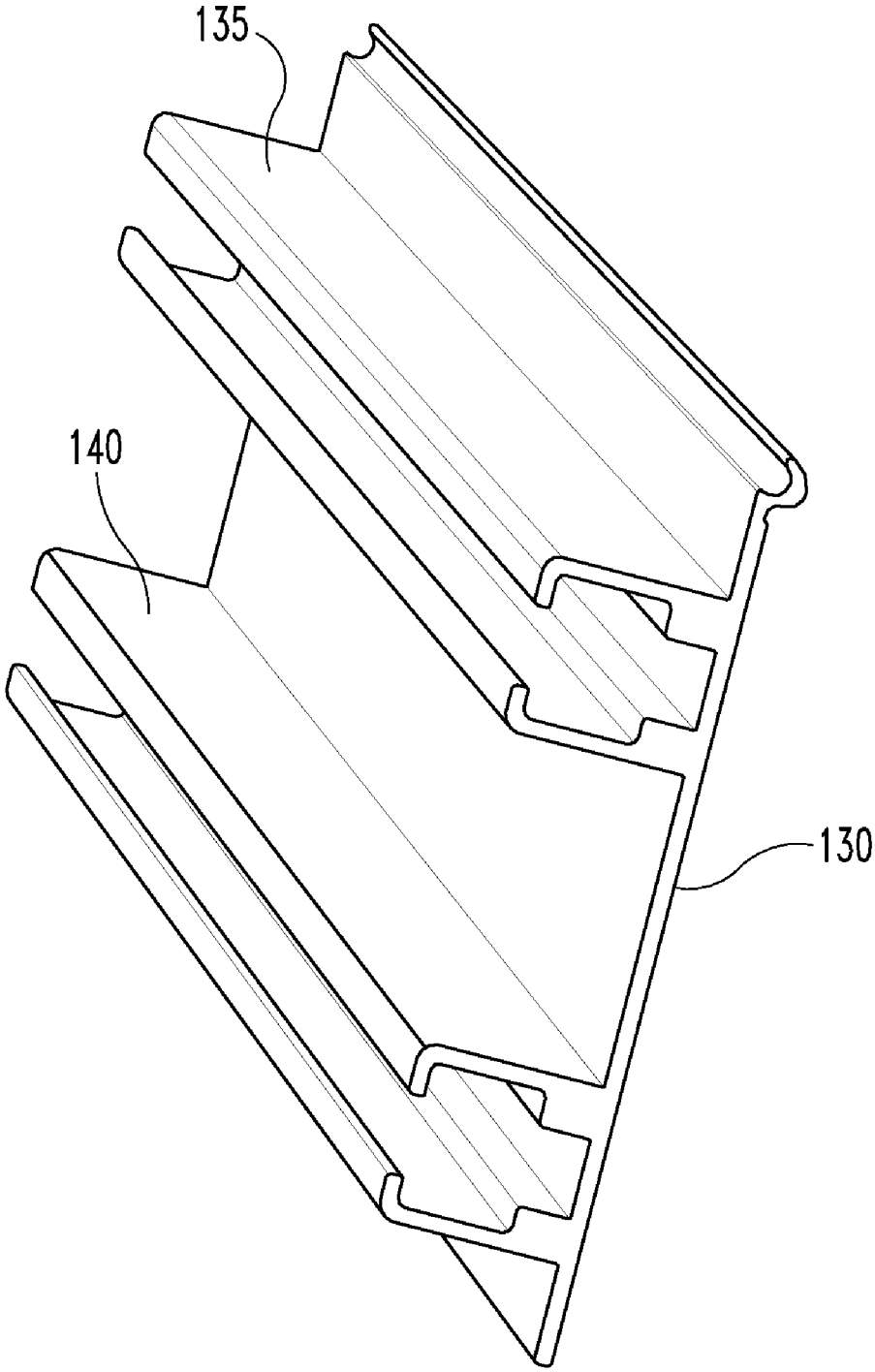
FIG. 9 is a perspective view of the riser of FIG. 8.
Figure 10:
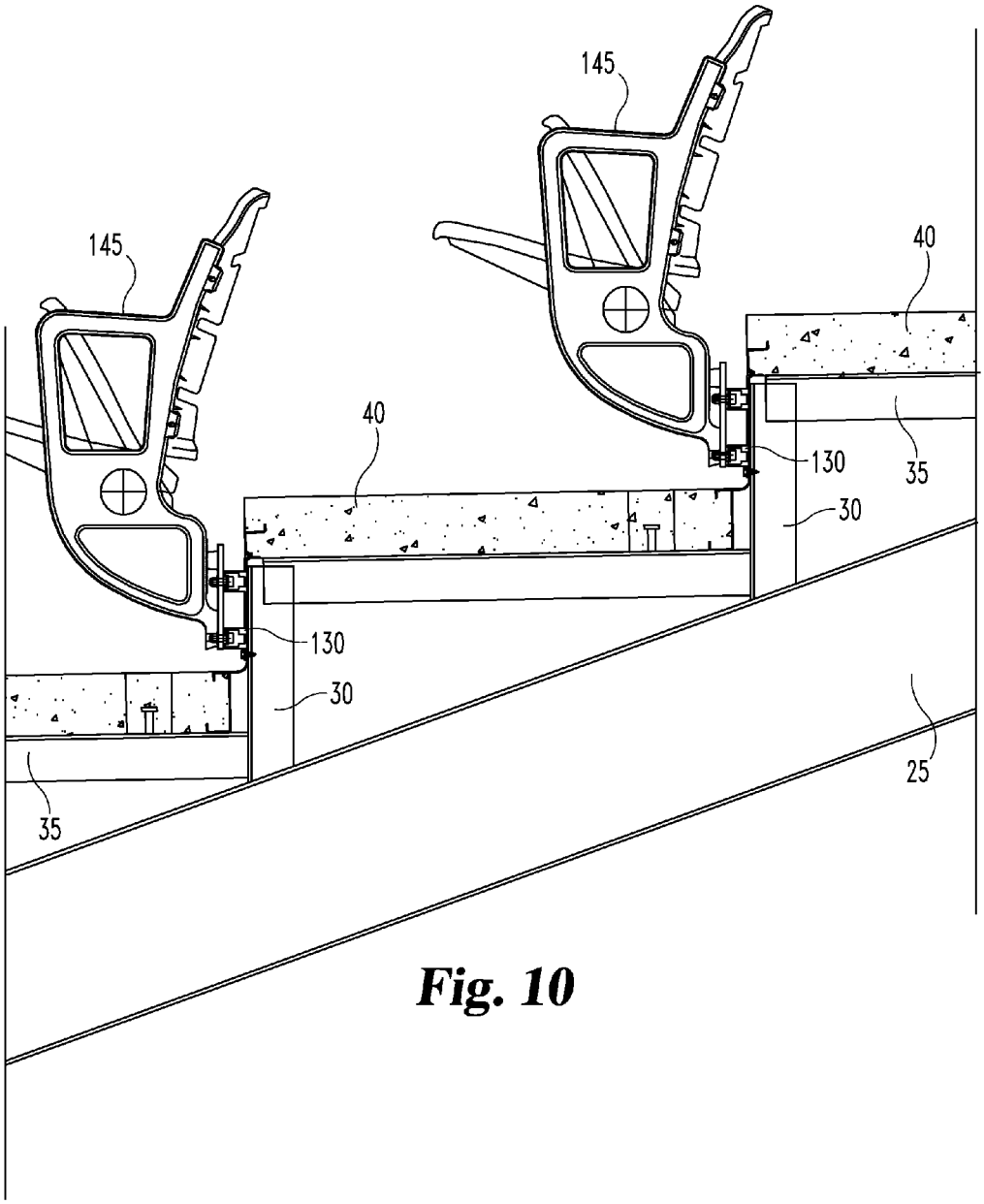
FIG. 10 is a side view of a stadium seating system according to a second embodiment of the present disclosure.
Figure 11:
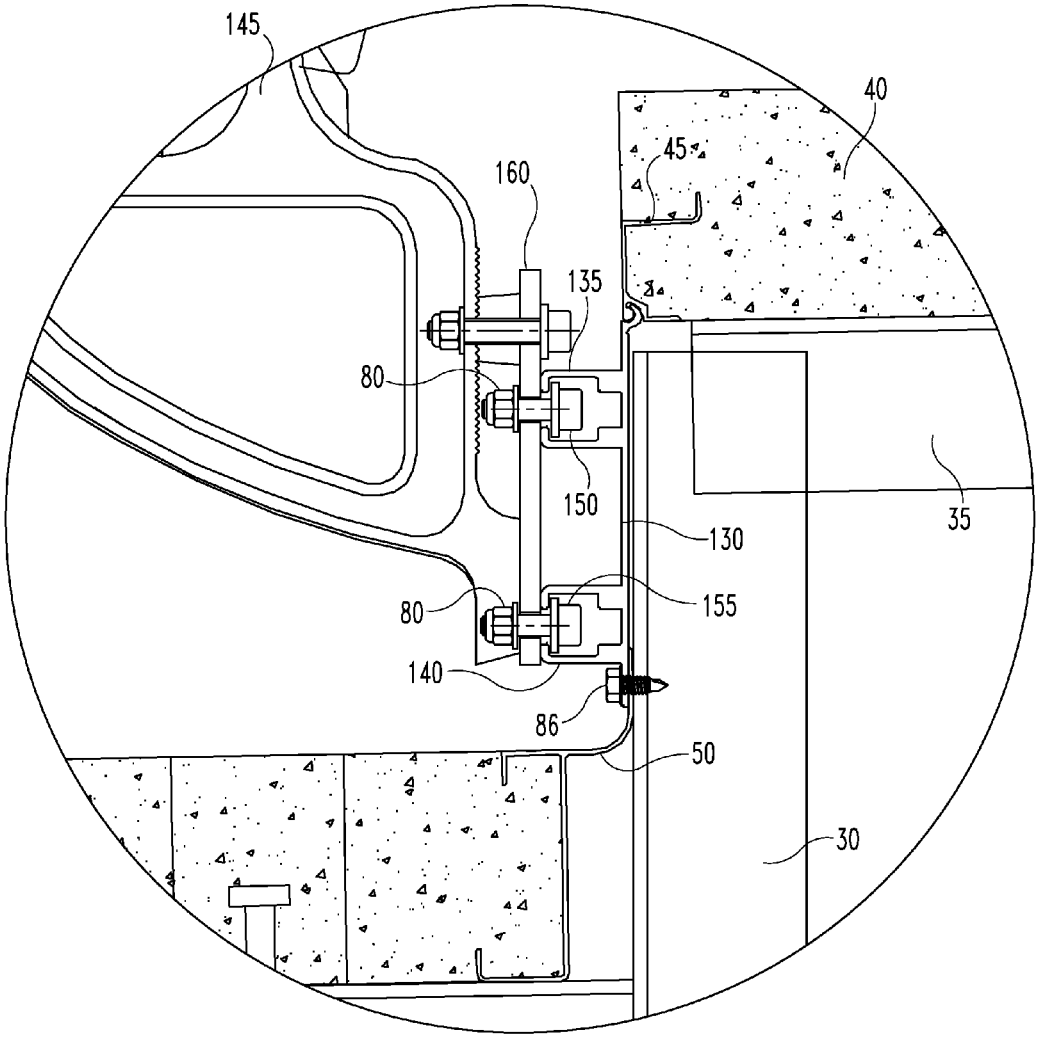
FIG. 11 is an enlarged side view of a portion of FIG. 10.
Figure 12:
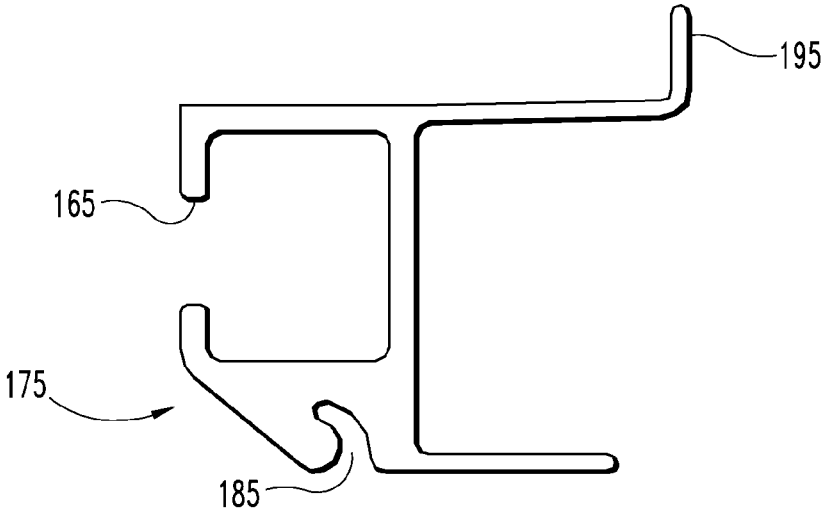
FIG. 12 is a cross-sectional view of an alternative front embed of the tread of FIG. 2 according to a further embodiment of the present disclosure.
Figure 13:
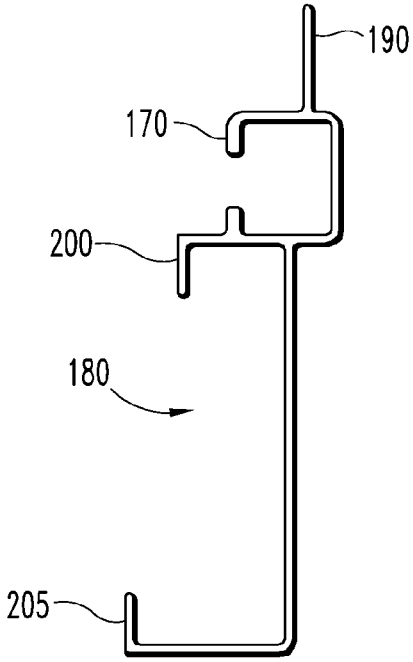
FIG. 13 is a cross-sectional view of an alternative rear embed of the tread of FIG. 2 according to a further embodiment of the present disclosure.

FIGS. 8 and 9 respectively show a cross-sectional profile and perspective view of a riser 130 according to another embodiment which has channels 135 and 140 formed therein. The channels 135, 140 may be utilized as mounting devices for seats or other attachments. For example, as shown in FIGS. 10 and 11, seats (illustrated here as chairs 145) may be attached to the channels 135, 140 using bolts 150, 155 or other appropriately sized fasteners. In one embodiment, the bolts 150, 155 may be inserted directly into the original mounting holes of the chair 145. In other embodiments, an adapter plate 160 may be used which provides an appropriate mounting transition between the chair 145 and riser 130. The use of adapter plate 160 allows for more mounting flexibility in relation to both the spacing of the original chair mounting points and the spacing of the channels 135, 140. It shall be understood that while two channels 135, 140 are shown in the illustrated embodiment, more or less than two channels may be included in the riser 130 depending on the requirements of the particular application. It shall be further understood that while the illustrated embodiment utilizes continuous horizontal channels to for mounting the chairs 145, the present disclosure contemplates that non-continuous and/or non-horizontal attachment devices may be formed within the risers 130.

Figure 14:
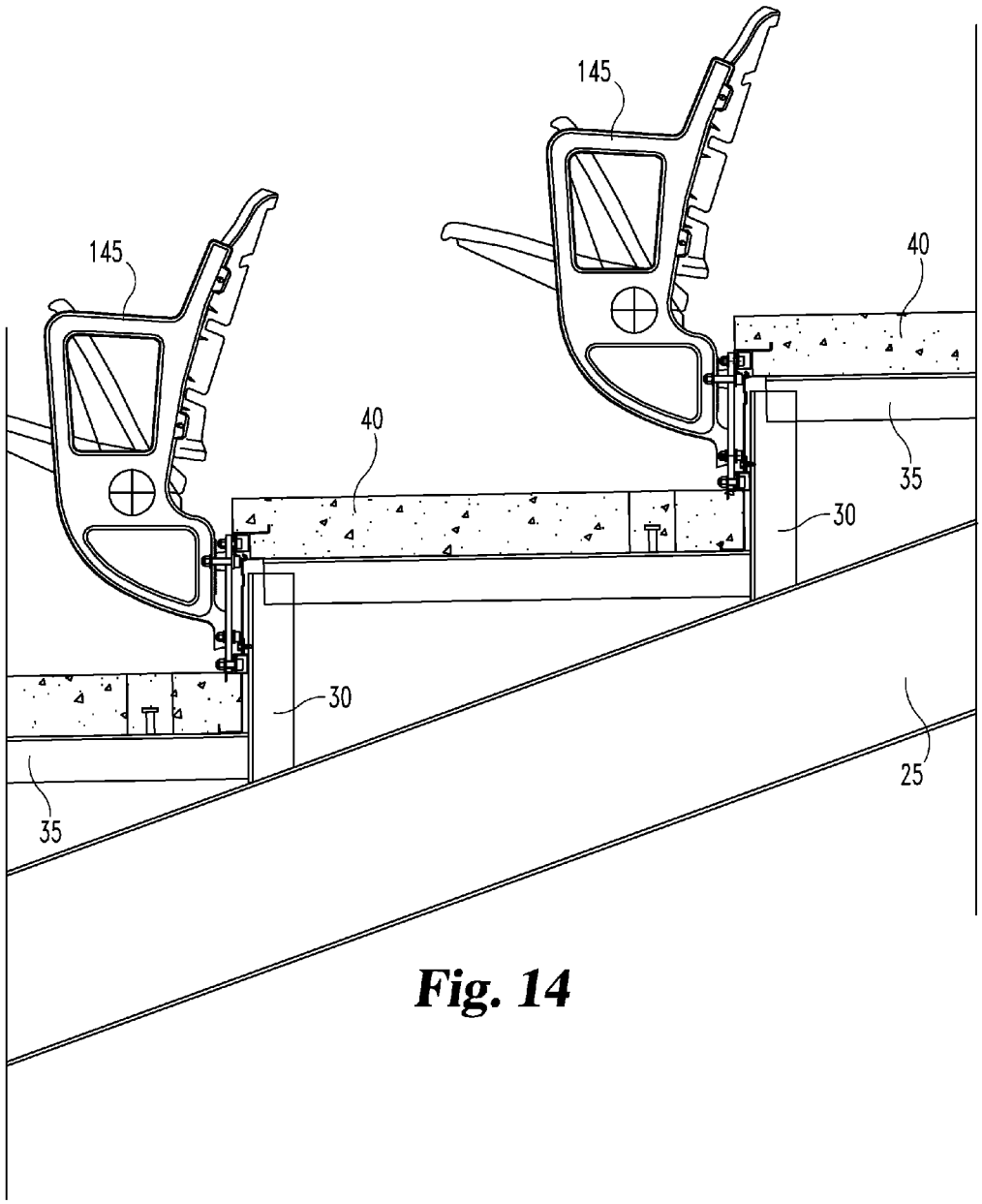
FIG. 14 is a side view of a stadium seating system according to the FIG. 10 embodiment of the present disclosure showing an alternative mounting for the seat to the vertical riser.
Figure 15:
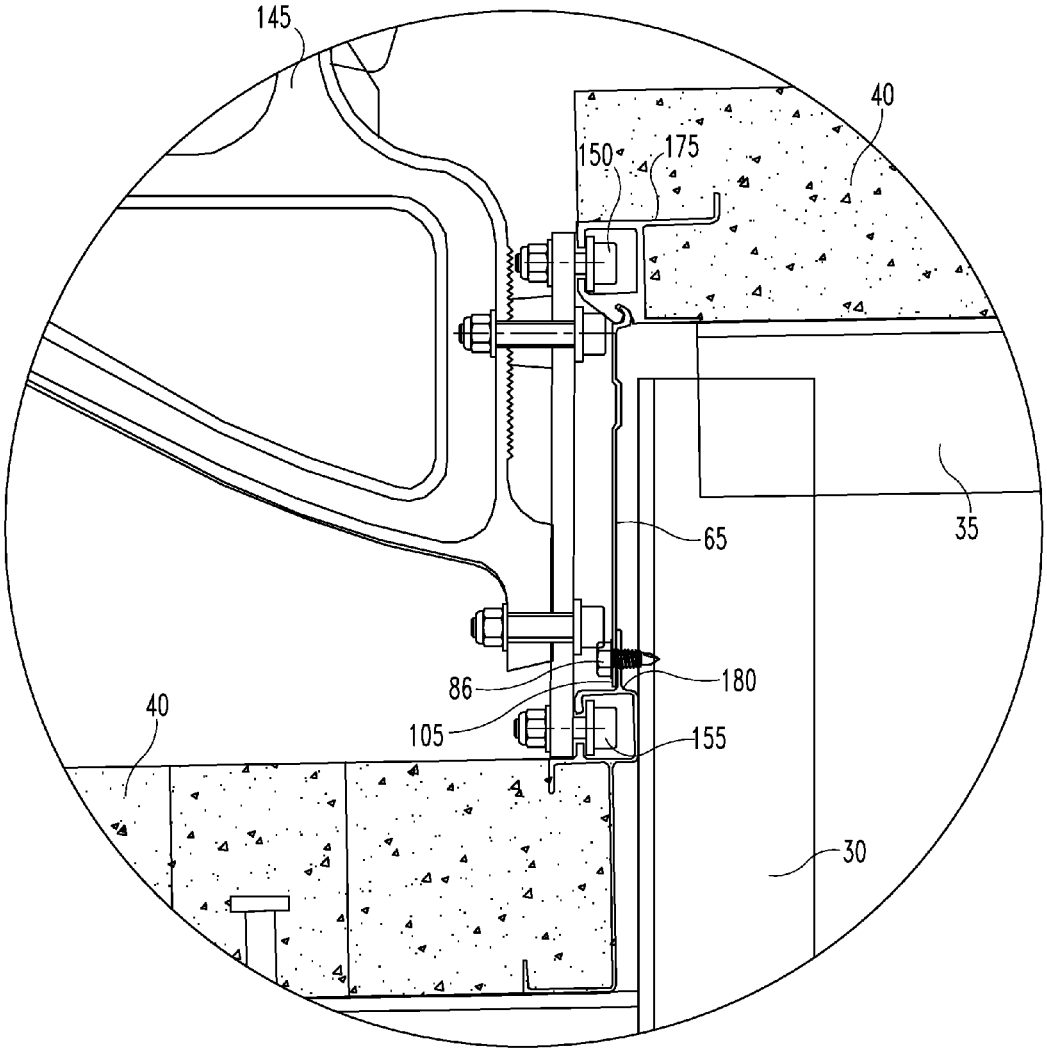
FIG. 15 is an enlarged side view of a portion of FIG. 14.

FIGS. 12-15 illustrate a further embodiment wherein channels 165, 170 are formed integral to embeds 175, 180 of the treads 40. Again, the front embed 175 may include a connection device such as female recess 185 which interlocks with the male lip portion 60 of the riser 65 as shown in FIGS. 14 and 15. Likewise, rear embed 180 may optionally include an upwardly-extending portion 190 which is positioned adjacent to the rear side of the lower portion of the riser 65 in a shingled configuration to effectively shed water and debris without the need for caulking or welding between the risers 65 and embeds 175 and 180.

The lower portion of the riser 65 may optionally be attached to the upwardly-extending portion 85 or 190 of rear embed 50 or 180 using a fastener, such as screw 86. In certain embodiments, screw 86 is configured as a "tek" or self-tapping screw, although other types of fasteners known in the art may be used. Screw 86 may be used in addition to or as an alternative to bolts 75 and nuts 80. When bolts 75 and nuts 80 are not used, the riser 65 may be held in place by the male lip portion 60 (which is engaged in recess 55 or 185) and the screw 86 as shown in FIGS. 11 and 15.

In order to provide additional positional integrity of the embeds 175, 180 within the concrete portion of treads 40, the embeds 175, 180 may optionally comprise additional lips 195, 200, 205 which extend perpendicularly within the concrete tread 40 as shown in FIGS. 12-15.

Figure 16:
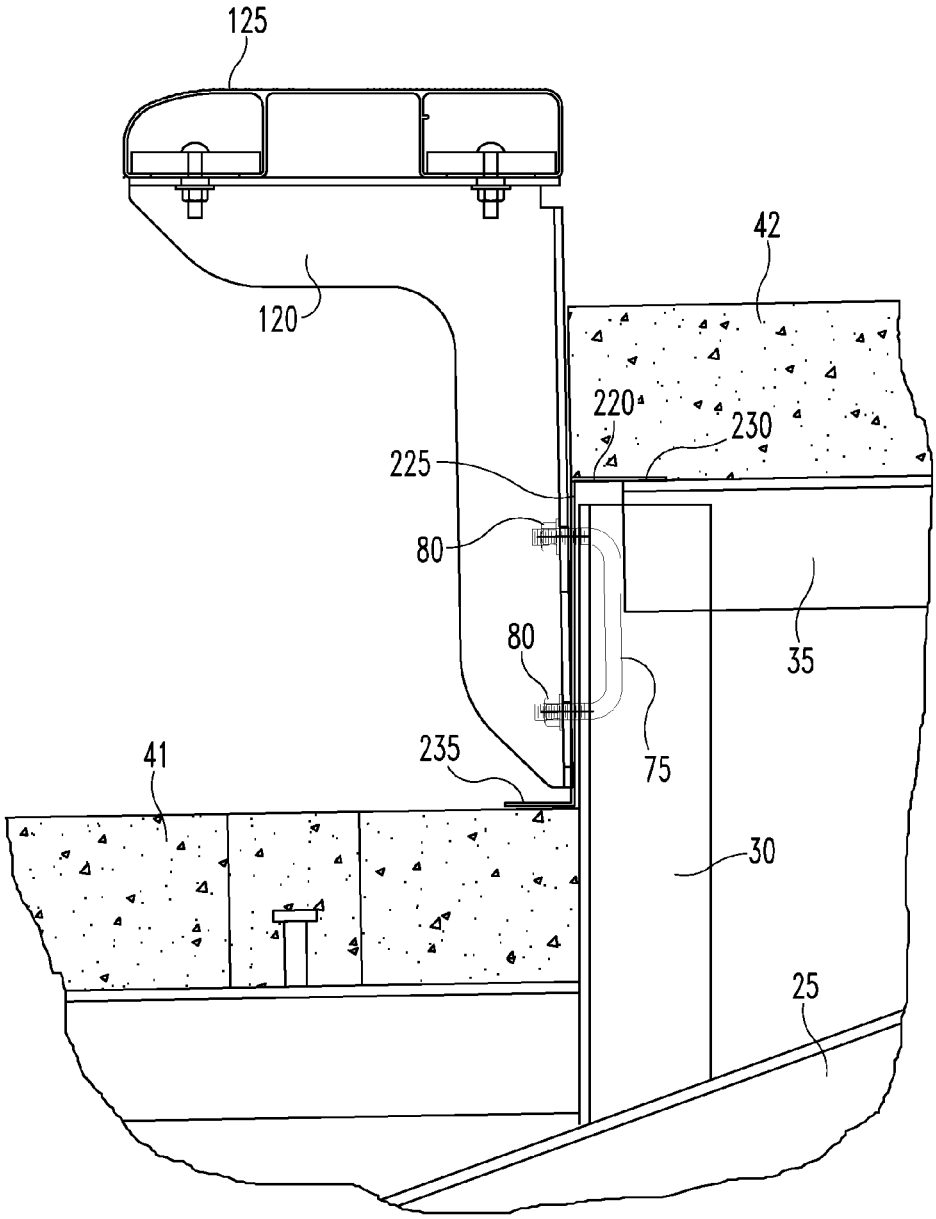
FIG. 16 is a side view of a stadium seating system according to a third embodiment of the present disclosure.
Figure 17:
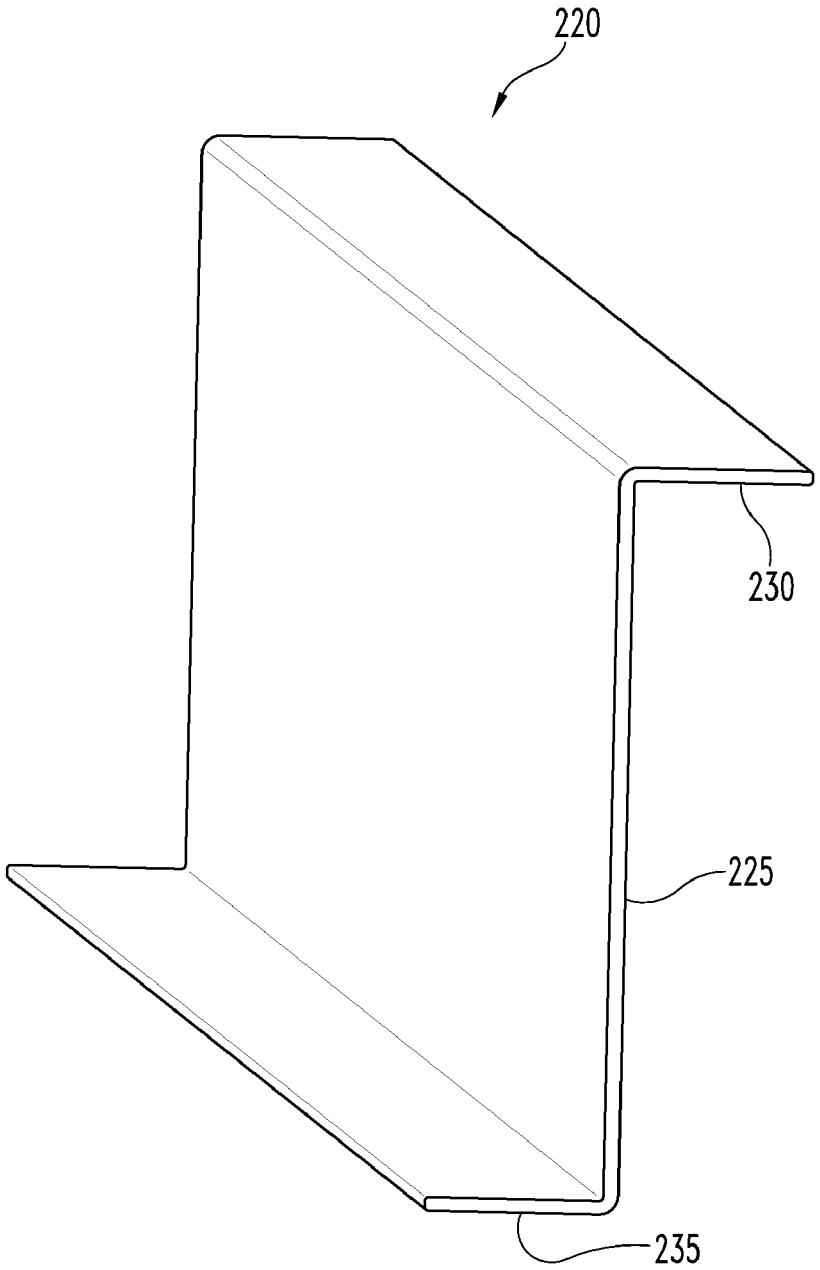
FIG. 17 is a perspective view of the riser utilized in the embodiment of FIG. 16.

FIGS. 16 and 17 show a further embodiment which utilizes a one-piece "Z" shaped riser 220. The riser 220 comprises a vertical portion 225, and upper horizontal portion 230, and a lower horizontal portion 235. When installed as shown in FIG. 16, the lower horizontal portion 235 rests on top of the lower adjacent tread 41. Likewise, the upper portion 230 is held between the upper adjacent tread 42 and supports 30, 35 as shown. The embodiment of FIG. 16 eliminates the need for front and rear embeds in the treads 41, 42, yet retains the ability to shed water. The riser 220 may be optionally secured to the supports 30 using bolts 75 and nuts 80 as shown.

Figure 18:
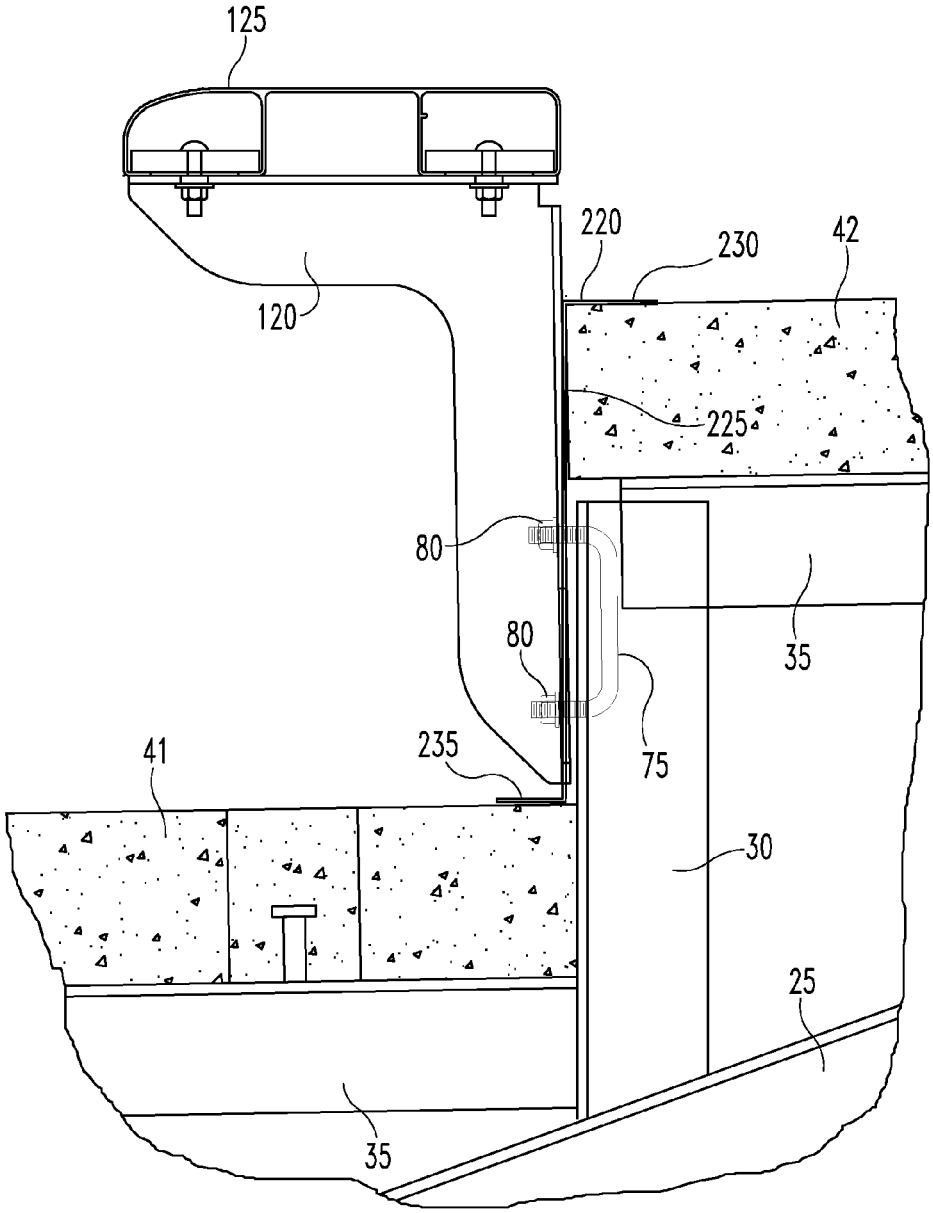
FIG. 18 is a side view of a stadium seating system according to the FIG. 16 embodiment of the present disclosure showing an alternative arrangement of the riser.

FIG. 18 shows a further embodiment wherein the vertical portion 225 of riser 220 is sized such that the upper portion 230 sits on top of the upper adjacent tread 42 when installed as shown. A sealing or adhesive material may be applied between the riser 220 and the tread 42 to maintain the water shedding ability of the system.

Figure 19:
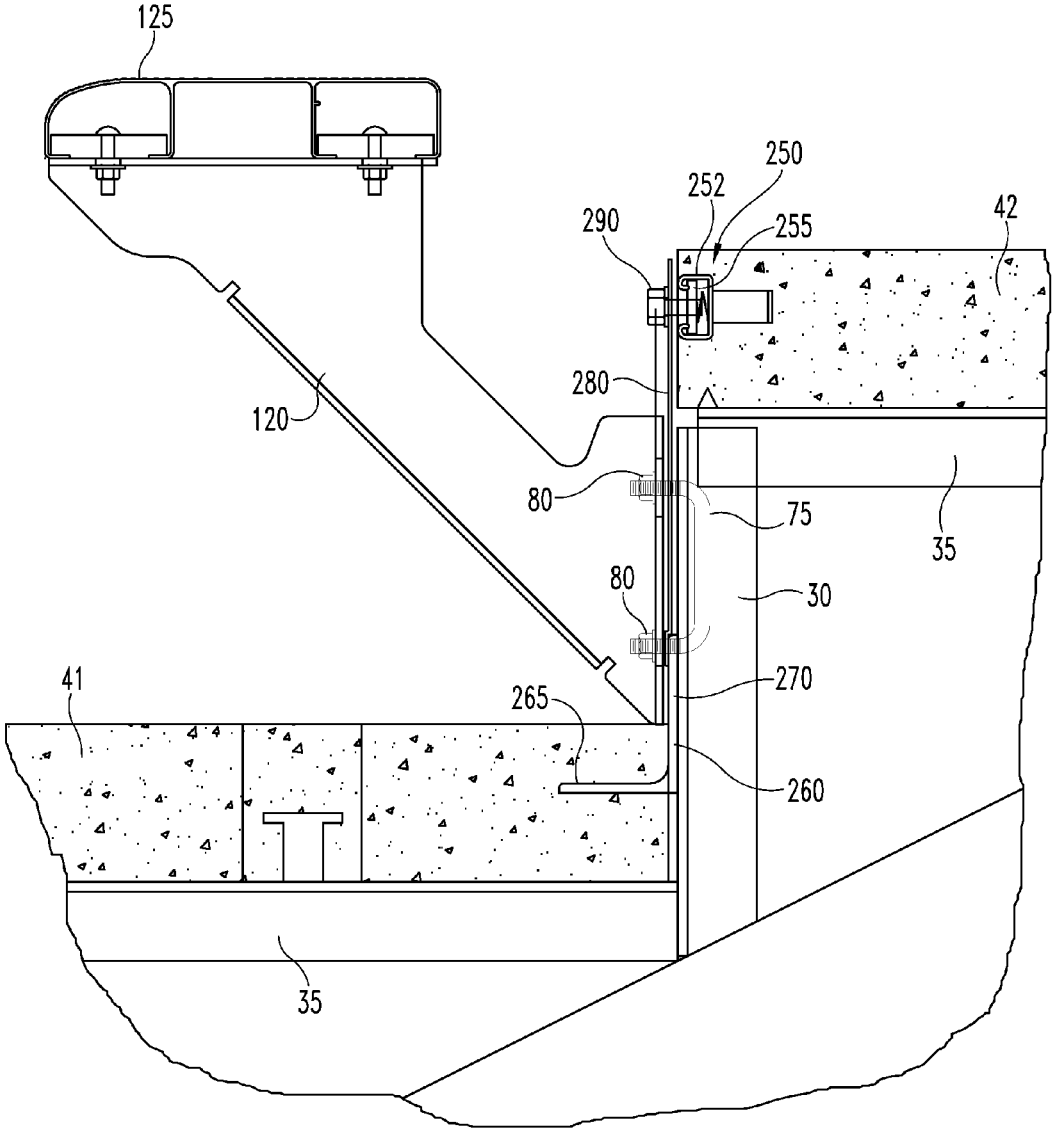
FIG. 19 is a side view of a stadium seating system according to a fourth embodiment of the present disclosure.

FIG. 19 shows a further embodiment utilizing a front fastener assembly 250, a vertical riser 280 and a rear bracket 260. As illustrated, fastener assembly 250 includes a channel 252 which is formed with a profile to allow the insertion and lateral adjustability of spring nuts 255 therein. The channel 252 may be pressed into a preformed recess within the tread 42 or set within the tread 42 when the tread 42 is poured. A bracket 260 is installed within the rear end of the lower adjacent tread 41. Bracket 260 comprises a horizontal portion 265 and a vertical portion 270 which sits adjacent the supports 30 when installed. The riser 280 is optionally held in place by bolts 290 and spring nuts 255 as shown. The lower portion of the riser 280 overlaps with the forward face of the vertical portion 270 of the rear bracket 260 of the lower adjacent tread 41. Again, a sealing or adhesive material may be added between the riser 280 and the upper adjacent tread 42 to prevent water seepage.

Figure 20:
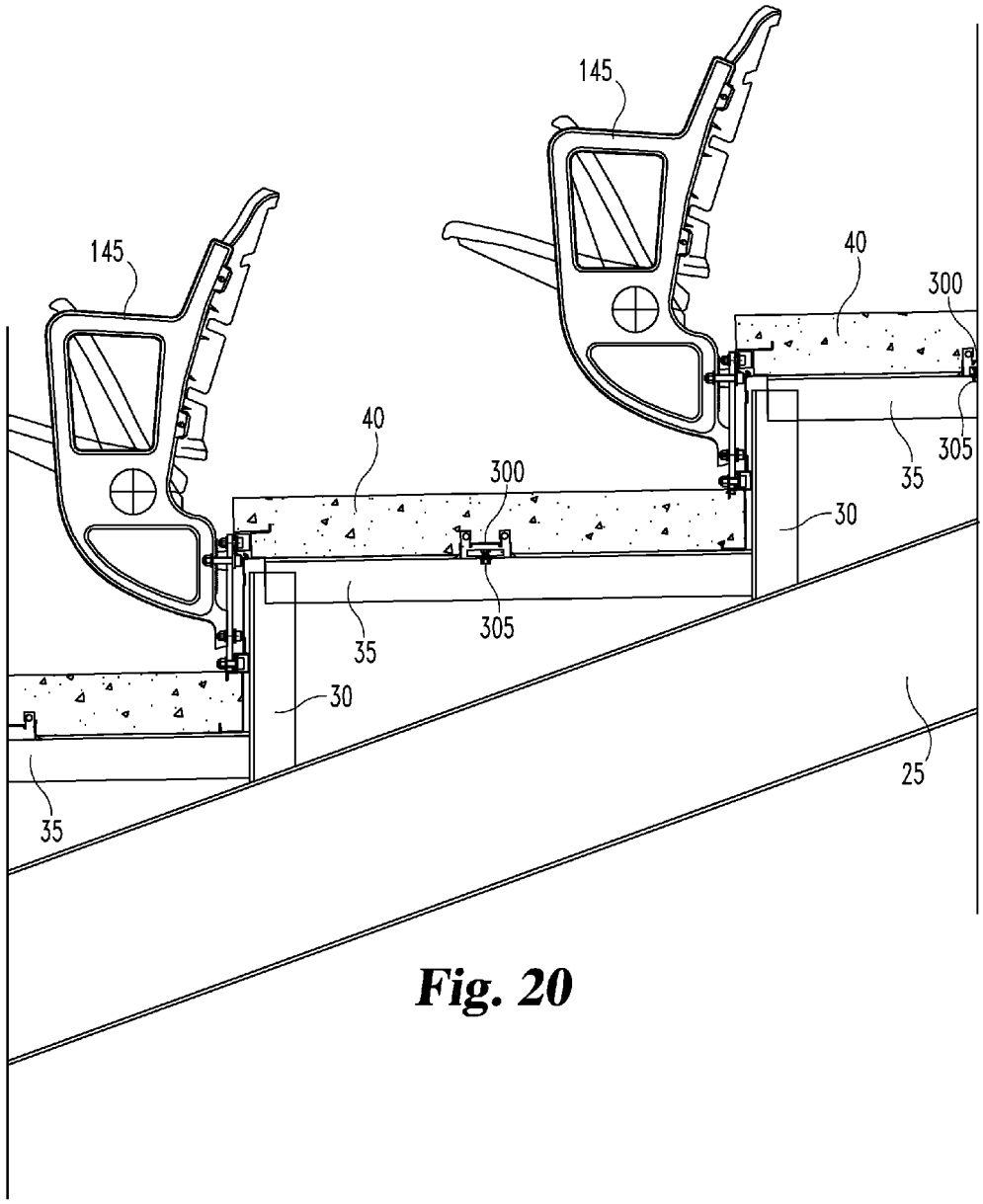
FIG. 20 is a side view of a stadium seating system according to a fifth embodiment of the present disclosure.
Figure 21:
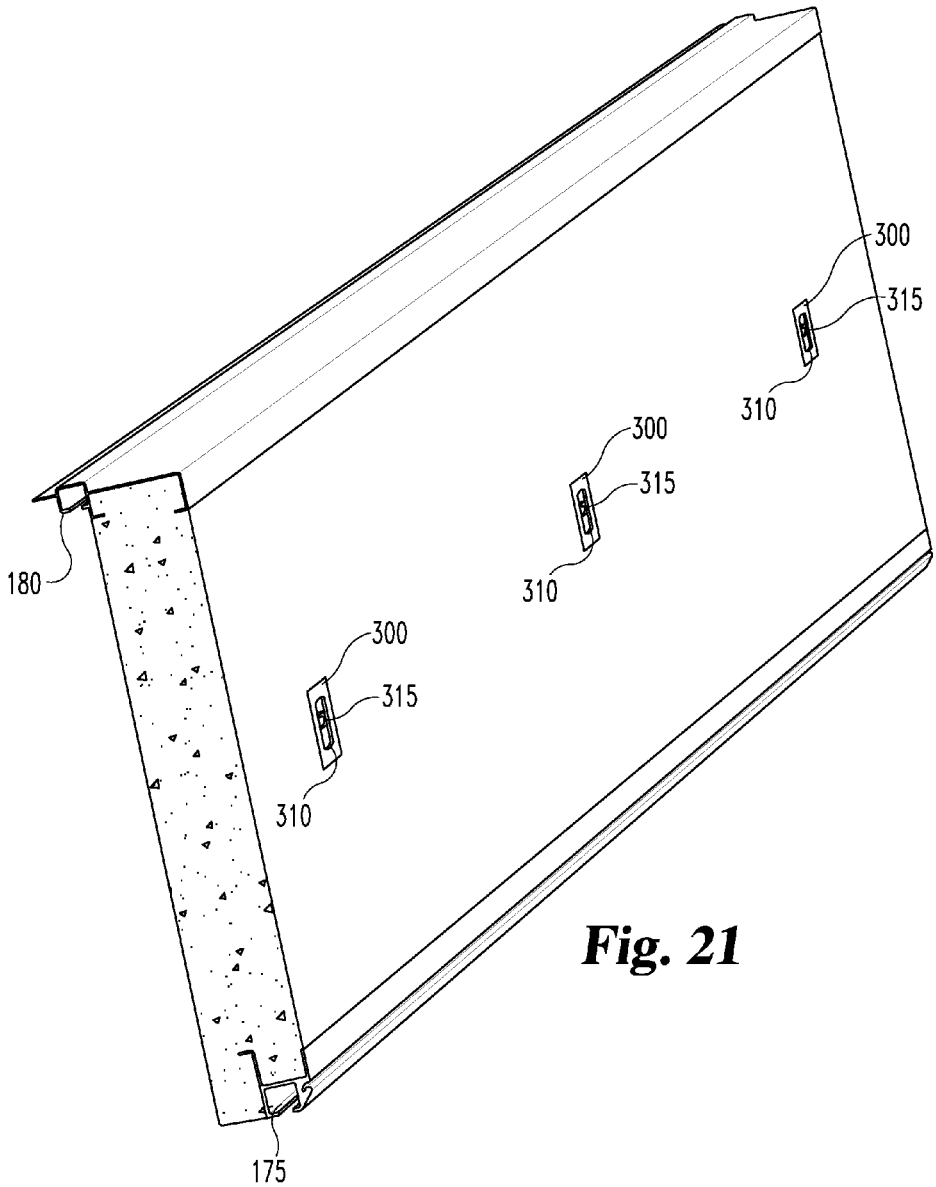
FIG. 21 is a lower perspective view of the tread utilized in FIG. 20 of the present disclosure showing additional embeds for attaching the tread to the understructure.
Figure 22:
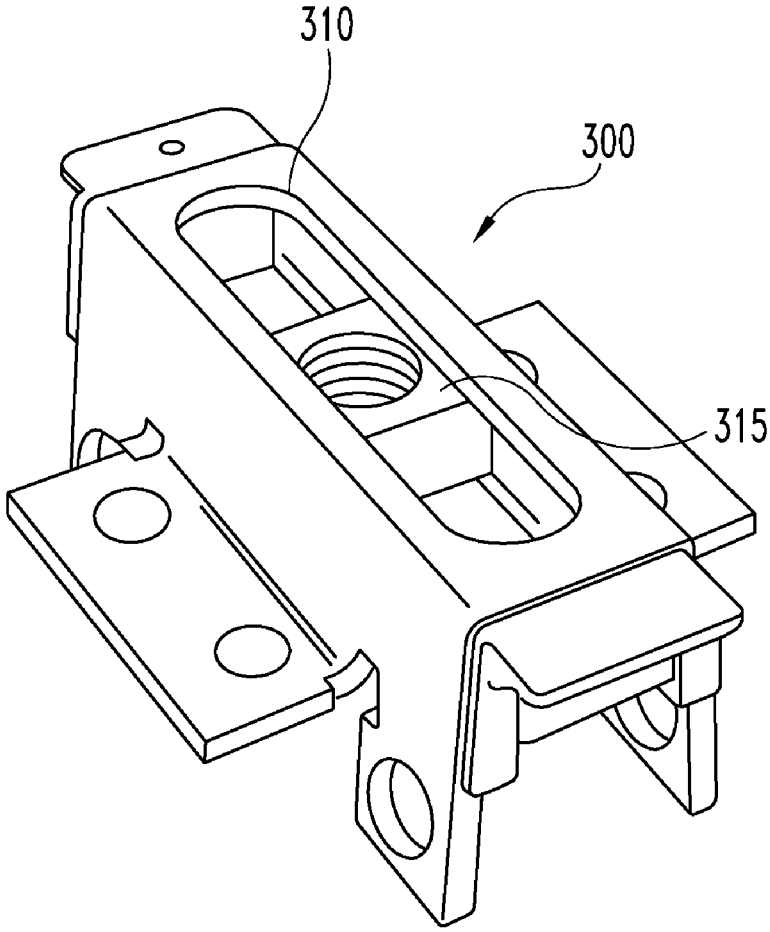
FIG. 22 is a perspective view of an embed for attaching the tread of FIG. 20 to the understructure.

FIGS. 20-22 depict a further embodiment utilizing a lower embed 300 for fastening the tread 40 to the runner support 35. Embed 300 is embedded within the concrete portion of the tread 40 and exposed through the bottom surface of tread 40, thereby preserving a continuous concrete top surface of the tread 40 while still allowing the tread 40 to be attached to the runner support 35. Embed 300 may comprise a metallic material, such as aluminum or steel, although other types of material may also be used including, but not limited to, plastic, fiberglass and composite materials. FIG. 22 shows an inverted perspective view of one example of the embed 300 prior to being embedded within the tread 40.

In one embodiment, embed 300 contains a captive nut 315 which is slidably disposed within a slot 310. The slot 310 allows the nut 315 to be positioned at the proper location relative to a corresponding screw 305 when installing the tread 40. Although the nut 315 may be positioned within the slot 310, nut 315 is prevented from rotating within the slot 310 to allow the corresponding screw 305 to engage the threads of the nut 315 during installation.

Screw 305 may be implemented in a variety of forms. For example, screw 305 may comprise a separate piece which is inserted through a hole in the runner support and into the nut 315. In other embodiments, screw 305 may comprise a threaded stud which is welded to the runner support 35 with a separate nut which may be tightened against the lower surface of the embed 300 to secure the tread 40 to the runner support 35.

It shall be understood that the while the illustrated embodiment shows the embed 300 as having a female threaded nut with the screw 305 having male threads, other configurations of the embed 300 are considered to be within the scope of the present disclosure. For example, the embed 300 may comprise a male threaded screw or stud which is held captive within the slot 310 and protrudes from the slot 310 and through a hole in the understructure to engage a corresponding female threaded nut which is attached from below the understructure. In still further embodiments, the embed 300 may comprise other types of fasteners known in the art to secure the embed 300 (along with tread 40) to the runner support 35.

The described embodiments provide the noise reduction, minimized vibration and deflection, and appearance of a fully concrete system, while at the same time offering the ease of installation, mounting flexibility and lower cost of a metallic system. In addition, certain embodiments of the disclosed system allow the installation of the risers 65, 130, 220 after the installation of the concrete treads 40 is completed. This eliminates the need to have multiple crews on the jobsite at one time and allows the metallic riser portions to be shipped to the jobsite later in the project.

The disclosed system also allows the use of a durable factory-applied finish on the risers 65, 130, 220 that is typically not available for concrete. For example, the risers 65, 130, 220 may be powder coated, whereas a concrete vertical surface would typically need to be painted to achieve a similar aesthetic impression, and would still lack the durability of powder coating.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A stadium seating construction system, comprising:

a tiered stadium seating support understructure;

a plurality of tiered concrete treads mounted to the stadium seating support understructure, at least one of said treads having a concrete body portion, a non-concrete front embed embedded within a front end of the concrete body portion, and a non-concrete rear embed embedded within a rear end of the concrete body portion, said front embed having a first connection device, said rear embed having an upwardly extending portion, said upwardly extending portion extending upwardly beyond the concrete body portion; and a plurality of tiered risers, at least one of said risers having an upper portion and a lower portion, the upper portion comprising a second connection device;

wherein the first connection device of at least one of the plurality of treads is adapted to interlock with the second connection device of a lower adjacent one of said plurality of risers; and wherein at least one of the risers is arranged such that a lower portion of the riser overlaps with a forward side of the upwardly extending portion of the rear embed of a lower adjacent tread.

2. The system of claim 1, wherein the risers, front embeds, and rear embeds are constructed from materials selected from the group consisting of metal, plastic, and fiberglass.

3. The system of claim 2, wherein said front and rear embeds are metallic.

4. The system of claim 2, wherein said front and rear embeds are aluminum.

5. The system of claim 1, wherein at least one of said concrete treads further comprises at least one hole through which a fastener for fastening the tread to the stadium seating support understructure may be inserted.

6. The system of claim 5, wherein said fastener includes a stud, the stud being attached to the support understructure prior to installation of the tread.

7. The system of claim 1, wherein at least one of said concrete treads further comprises at least one non-concrete lower embed, said non-concrete lower embed having a fastener for fastening the tread to the stadium seating support understructure.

8. The system of claim 7, wherein the lower embed is only exposed through the bottom surface of the concrete tread.

9. The system of claim 7, wherein the lower embed comprises a slot to allow the position of the fastener to be adjusted.

10. The system of claim 1, wherein each one of said plurality of risers is further attached to said support understructure.

11. The system of claim 1, wherein the upwardly extending portion of the rear embed includes an upwardly substantially curved portion.

12. The system of claim 1, wherein the upwardly extending portion of the rear embed comprises an upwardly substantially curved portion which transitions to a substantially vertical portion.

13. The system of claim 1, wherein the front embed further comprises a first attachment device for attaching a first seat; and wherein the rear embed further comprises a second attachment device for attaching a second seat.

14. The system of claim 13, wherein said first attachment device comprises a first horizontal channel for receiving a first fastener, said first fastener being operative to attach the first seat to the first horizontal channel; and wherein said second attachment device comprises a second horizontal channel for receiving a second fastener, said second fastener being operative to attach the second seat to the second horizontal channel.

15. The system of claim 1, wherein at least one of said plurality of risers further comprises:

at least one attachment device for attaching a seat.

16. The system of claim 15, wherein said attachment device comprises at least one horizontal channel for receiving a fastener, said fastener being operative to secure a seat to said at least one horizontal channel.

17. The system of claim 1, wherein said plurality of tiered concrete treads are formed of pre-cast concrete.

18. A stadium seating construction system, comprising:

a tiered stadium seating support understructure having tiered riser supports;

a plurality of tiered concrete treads mounted to the stadium seating support understructure, at least one of said treads having a concrete body portion, a front embed embedded within a front end of the concrete body portion, and a rear embed embedded within a rear end of the concrete body portion, said rear embed having an upwardly extending portion, said upwardly extending portion extending upwardly beyond the concrete body portion; and a plurality of tiered risers attached to said tiered riser supports, at least one of said risers having an upper portion and a lower portion;

wherein at least one of the risers is mounted such that the upper portion of the riser overlaps with the front embed of a first one of the treads and the lower portion of the riser overlaps with the upwardly extending portion of the rear embed of a second one of the treads; and wherein the risers, front embeds, and rear embeds are constructed from materials selected from the group consisting of metal, plastic, and fiberglass.

19. The system of claim 18, wherein said front and rear embeds are metallic.

20. The system of claim 18, wherein said front and rear embeds are aluminum.

21. The system of claim 18, wherein said front and rear embeds are formed as a single piece.

22. The system of claim 18, wherein at least one of the risers is arranged such that a lower portion of the riser is adjacent to a forward side of the upwardly extending portion of the rear embed of a lower adjacent tread.

23. The system of claim 18, wherein said front embed comprises a downwardly extending portion; and wherein at least one of the risers is arranged such that the upper portion of the riser is adjacent to a rear side of the downwardly extending portion of the front embed of an upper adjacent tread.

24. The system of claim 18, wherein said front embed comprises a first connection device;

wherein the upper portion of at least one of the risers comprises a second connection device; and wherein said first connection device of at least one of the plurality of treads is adapted to interlock with the second connection device of a lower adjacent one of said plurality of risers.

25. The system of claim 18, wherein at least one of said concrete treads further comprises at least one hole through which a fastener for fastening the tread to the stadium seating support understructure may be inserted.

26. The system of claim 25, wherein said fastener includes a stud, the stud being attached to the support understructure prior to installation of the tread.

27. The system of claim 18, wherein at least one of said concrete treads further comprises at least one non-concrete lower embed, said non-concrete lower embed having a fastener for fastening the tread to the stadium seating support understructure.

28. The system of claim 27, wherein the lower embed is only exposed through the bottom surface of the concrete tread.

29. The system of claim 27, wherein the lower embed comprises a slot to allow the position of the fastener to be adjusted.

30. The system of claim 18, wherein at least one of said plurality of risers is further attached to said support understructure.

31. The system of claim 18, wherein the upwardly extending portion of the rear embed includes an upwardly substantially curved portion.

32. The system of claim 18, wherein the upwardly extending portion of the rear embed comprises an upwardly substantially curved portion which transitions to a substantially vertical portion.

33. The system of claim 18, wherein the front embed further comprises a first attachment device for attaching a first seat; and wherein the rear embed further comprises a second attachment device for attaching a second seat.

34. The system of claim 33, wherein said first attachment device comprises a first horizontal channel for receiving a first fastener, said first fastener being operative to attach the first seat to the first horizontal channel; and wherein said second attachment device comprises a second horizontal channel for receiving a second fastener, said second fastener being operative to attach the second seat to the second horizontal channel.

35. The system of claim 18, wherein at least one of said plurality of risers further comprises:

at least one attachment device for attaching a seat.

36. The system of claim 35, wherein said attachment device comprises at least one horizontal channel for receiving a fastener, said fastener being operative to secure a seat to said at least one horizontal channel.

37. A stadium seating construction system, comprising:

a tiered stadium seating support understructure;

a plurality of tiered concrete treads mounted to the stadium seating support understructure, at least one of said treads having a concrete body portion, a front embed embedded within a front end of the concrete body portion, and a rear embed embedded within a rear end of the concrete body portion, said rear embed having an upwardly extending portion, said upwardly extending portion extending upwardly beyond the concrete body portion; and a plurality of tiered risers, at least one of said risers having an upper portion and a lower portion;

wherein at least one of the risers is mounted in a shingled fashion relative to an upper adjacent tread and the upwardly extending portion of the rear embed of a lower adjacent tread to achieve a water shedding effect; and wherein the risers, front embeds, and rear embeds are constructed from materials selected from the group consisting of metal, plastic, and fiberglass.

38. A stadium seating construction system, comprising:

a tiered stadium seating support understructure;

a plurality of tiered concrete treads mounted to the stadium seating support understructure, at least one of said concrete treads comprising a concrete body portion, a front embed, and a rear non-concrete member, said rear non-concrete member extending upwardly beyond said concrete body portion; and a plurality of tiered risers, at least one of said risers having an upper portion and a lower portion;

wherein at least one of the risers is attached to the front embed of an upper adjacent one of said concrete treads using a fastener;

wherein the lower portion of at least one of the risers is mounted in a shingled fashion relative to said rear non-concrete member of a lower adjacent tread to achieve a water shedding effect; and wherein the risers, front embeds, and rear rear non-concrete member are constructed from materials selected from the group consisting of metal, plastic, and fiberglass.

39. The system of claim 38, wherein the lower portion of at least one of the risers overlaps with a front side of said non-concrete member to achieve a water shedding effect.

* * * * *

UNITED STATES PATENT AND TRADEMARK OFFICE

CERTIFICATE OF CORRECTION

PATENT NO. : 8,266,842 B2
APPLICATION NO. : 12/780310
DATED : September 18, 2012
INVENTOR(S) : Bruce C. Merrick It is certified that error appears in the above-identified patent and that said Letters Patent is hereby corrected as shown below:

Col. 10, line 51, delete the first "rear" as it is duplicative

Signed and Sealed this
Thirteenth Day of November, 2012

David J. Kappos

David J. Kappos
*Director of the United States Patent and Trademark Office*